US010842201B2

(12) United States Patent
Mizoguchi et al.

(10) Patent No.: US 10,842,201 B2
(45) Date of Patent: Nov. 24, 2020

(54) BRASSIERE

(71) Applicants: Hatsuko Mizoguchi, New York, NY (US); Tsutomu Mizoguchi, New York, NY (US)

(72) Inventors: Hatsuko Mizoguchi, New York, NY (US); Tsutomu Mizoguchi, New York, NY (US)

( * ) Notice: Subject to any disclaimer, the term of this patent is extended or adjusted under 35 U.S.C. 154(b) by 200 days.

(21) Appl. No.: 16/010,406

(22) Filed: Jun. 16, 2018

(65) Prior Publication Data

US 2019/0045853 A1 Feb. 14, 2019

Related U.S. Application Data

(60) Provisional application No. 62/520,811, filed on Jun. 16, 2017.

(51) Int. Cl.
*A41C 3/12* (2006.01)
*A41C 3/00* (2006.01)

(52) U.S. Cl.
CPC ..... *A41C 3/005* (2013.01); *A41C 3/0021* (2013.01); *A41C 3/0028* (2013.01); *A41C 3/12* (2013.01)

(58) Field of Classification Search
CPC ..... A41C 3/0021; A41C 3/0028; A41C 3/12; A41C 3/005
USPC ..... 450/1, 86, 59, 62, 87, 68
See application file for complete search history.

(56) References Cited

U.S. PATENT DOCUMENTS 2,313,811 A * 3/1943 Dubner ..... A41C 3/0028 450/68
2,457,928 A * 1/1949 Silva ..... A41C 3/00 450/86
2,462,987 A * 3/1949 Michaelson ..... A41C 3/00 450/86
5,167,566 A * 12/1992 Novitsky ..... A41C 3/00 2/67
5,823,857 A * 10/1998 Tan ..... B23F 15/06 451/47
6,918,812 B2 * 7/2005 Giese ..... A41C 3/0021 450/65
8,864,550 B2 * 10/2014 Gleeson ..... A41C 3/0021 450/60
9,314,056 B2 * 4/2016 Skov ..... A41D 13/1146
2010/0120329 A1 * 5/2010 MacDonald ..... A41C 3/0021 450/40

FOREIGN PATENT DOCUMENTS

JP 2000-273705 A 10/2018

* cited by examiner

*Primary Examiner* — Gloria M Hale
(74) *Attorney, Agent, or Firm* — W&K IP

(57) ABSTRACT

Provided is a brassiere that can keep the movement of the breasts and reduce fastening while maintaining the shape of the breasts. A brassiere 1 includes: left and right cup bodies 10 for holding the breasts; left and right upper supporting bodies 20 which are hung around the shoulders of a human body while being connected with the upper ends of the cup bodies 10 at one end; left and right lower supporting bodies 30 for supporting the lower ends of the cup bodies 10, the upper ends thereof being connected with the lower ends of the cup bodies 10 and extending in the left-right direction while rising obliquely upward at a predetermined angle in a curved shape.

7 Claims, 6 Drawing Sheets

BRASSIERE

CROSS-REFERENCE TO RELATED APPLICATIONS

This application claims priority of U.S. Provisional Patent Application No. 62/520,811, filed Jun. 16, 2017, the entire contents of which are incorporated herein by reference.

TECHNICAL FIELD

The present invention relates to a brassiere and particularly to a brassiere having left and right cup bodies for holding the breasts of a human body.

BACKGROUND

Various brassieres have been developed conventionally. Such a brassiere has been devised variously so that the shape of the breasts of the human body can be well maintained. Such a technique is referred to, for example, the technique described in Patent Document 1 (Japanese Patent Application Laid-Open 2000-273705)

SUMMARY

Problems to be Solved

That is, in the conventional brassiere, for example, by devising the shape of the brassiere or by using wires, rubber, or the like, the shape of the breasts has been favorably maintained. But holding the shape of the breasts is given priority so much that the movement of the breasts is limited or the breasts are forcibly fastened and held in an unreasonable shape, causing stiff shoulders and lower back pain, which may cause stress on the wearing of the brassiere and has brought adverse effect on the human body. For this reason, it has been strongly desired to develop a brassiere that can keep the movement of the breasts while maintaining the shape of the breasts, and can also reduce the fastening and the stress of wearing.

The present invention has been made in view of the above circumstances, and an object is to provide a brassiere that can reduce the wearing stress while maintaining the shape of the breasts.

Means for Solving the Problems

In order to achieve the above object, the invention of claim 1 is a brassiere including: left and right cup bodies for holding the breasts of a human body; left and right upper supporting bodies for supporting the cup bodies from above; and left and right lower supporting bodies for supporting the lower ends of the cup bodies, the left and right lower supporting bodies being connected with the lower ends of the cup bodies and extending in the left-right direction. The lower end of the cup body and the lower supporting body are separated from each other while widening the interval gradually toward the intermediate portion between the left and right cup bodies so as to form an opening between the lower end of the cup body and the lower supporting body.

According to the present invention, the lower end of the cup body and the lower supporting body are separated from each other while widening the interval gradually toward the intermediate portion between the left and right cup bodies and an opening is formed between the lower end of the cup body and the lower supporting body. Therefore, it is possible to maintain the shape of the breast by the cup body and the lower supporting body, and keep the movement of the breast and reduce the fastening and wearing stress by separating the lower end of the cup body and the lower supporting body while widening the interval gradually toward the intermediate portion.

The cup body is composed of a first region corresponding to the center position of the breast of the human body, and a second region and third region located on both sides of the first region. The two sides' edge portions of the first region are further overlapped by a fabric from the upper end to the lower end, and the upper supporting body includes a first upper supporting body and a second upper supporting body thereof, wherein the first upper supporting body extends upward from the upper end of one edge portion of the left and right edge portions of the first region, and the second upper supporting body extends upward from the upper end of the other edge portion of the left and right edge portions of the first region. In that case, it is possible to keep the central portion of the breast between the first upper supporting body and the second upper supporting body and maintain a good shape (claim 2).

In the case where the first upper supporting body is continuously formed with the further overlapped fabric of one side edge portion of the first region of the cup body, and the second upper supporting body is continuously formed with the further overlapped fabric of the other edge portion of the first region of the cup body, it is possible to further keep the central portion of the breast between the first upper supporting body and the second upper supporting body and maintain the breast in a good shape (claim 3).

In the case where the lower end of one edge portion of the first region of the cup body continuously formed with the first upper supporting body is connected with the upper end of the lower supporting body, and the lower end of the other side edge portion of the first region of the cup body continuously integrated with the second upper supporting body is located at the upper end of the opening and separated from the lower supporting body via the opening, it is possible to further maintain the shape of the breast by the first upper supporting body, the second upper supporting body, the cup body and the lower supporting body, and it is also possible to keep the free movement of the breast by separating the lower end of the other edge portion of the first region from the upper end of the lower supporting body (claim 4).

In the case where a left and right fastening body for fastening the lower supporting bodies to the human body is provided, wherein the lower supporting body further extends in the left-right direction from the lower end of the cup body to a corresponding position of the back part of the human body, and the left and right end portions thereof are separated from each other at the corresponding position of the back part of the human body, the fastening body extends in the left-right direction from each of the left and right end portions of the lower supporting body, and the end portions of the fastening body reach a corresponding position of the front part of the human body, when pulling the fastening body in the left-right direction, the left and right lower supporting bodies are also pulled and the interval between the separated end portions becomes narrower, so that the lower supporting bodies can be fastened to the human body. In addition, it is possible to tie the end portions of the fastening body at the front part of the human body, to easily perform the fastening work, and it is also possible to easily adjust the fastening force (claim 5).

Here, the brassiere can be formed by using a natural material (claim 6), and the natural material can be Oshima pongee, cotton, or linen (claim 7).

Effects

According to the present invention, it is possible to reduce the stress of wearing while maintaining the shape of the breast.

DETAILED DESCRIPTION

Figure 1:
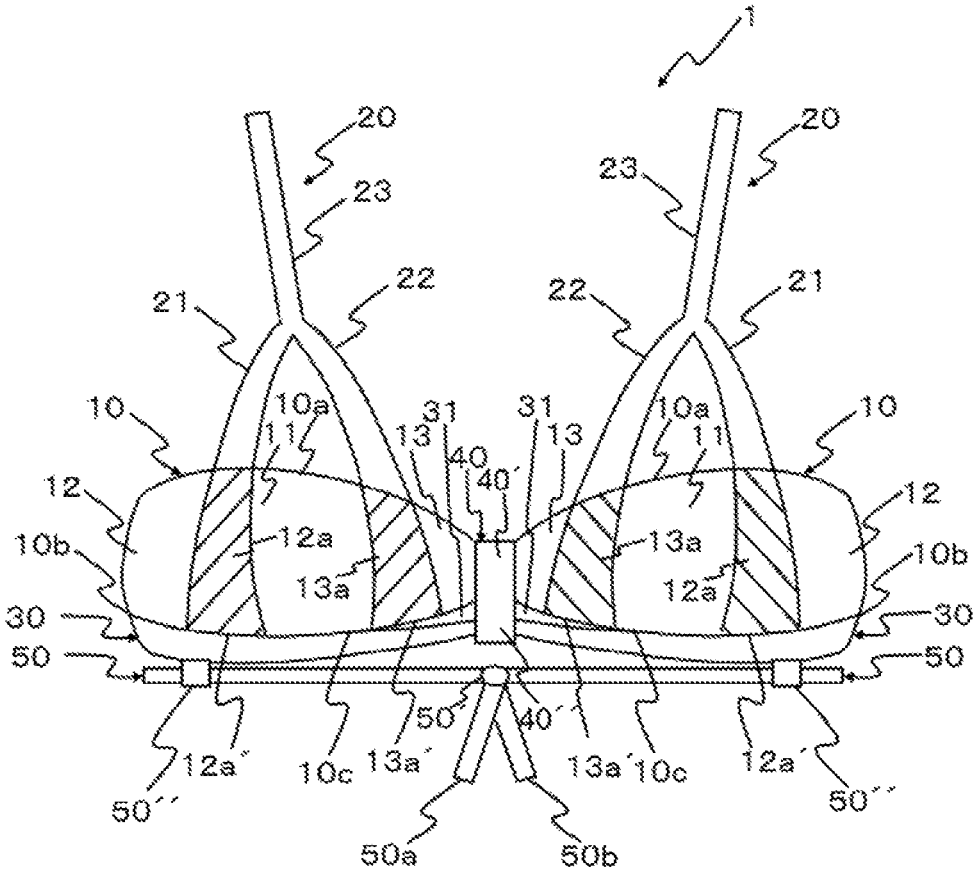
FIG. 1 is a front view showing an overall configuration of a brassiere according to an embodiment of the present invention.
Figure 2:
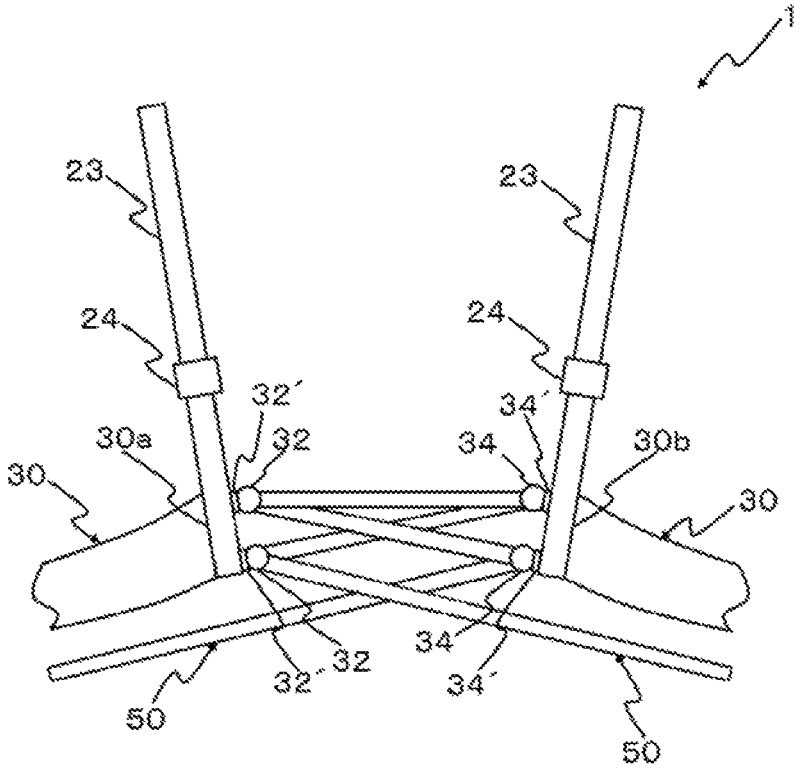
FIG. 2 is a rear view showing the overall configuration of the same brassiere.

Hereinafter, embodiments of the present invention will be described in detail with reference to the drawings. FIG. 1 is a front view showing an overall configuration of a brassiere 1 illustrating an embodiment of the present invention. In the following description, front and rear, left and right, up and down are defined with reference to a human body in a state where the brassiere has been worn on.

The outline of the brassiere 1 of the present invention will be described with reference to these figures. This brassiere 1 holds a human body, more specifically, the breasts of a woman, and the whole brassiere is formed by using a natural material, more specifically, Oshima pongee. The brassiere 1 includes cup bodies 10, upper supporting bodies 20, lower supporting bodies 30, a connecting body 40, and a fastening body 50.

The cup bodies 10 are provided on the left and right sides, more specifically, a dome shape, and have a function of holding the breasts of the human body.

The cup body 10 is divided into three regions in the left-right direction, including: a first region 11 corresponding to the center position of the breast of the human body, and a second region 12 and a third region 13 located on the left and right sides of the first region 11.

The cup body 10 is formed by overlapping one piece of fabric or several pieces of fabric. In the first region 11, an side edge portion 12*a* of the side end adjacent to the second region 12 and an edge portion 13*a* of the side end adjacent to the third region 13 are formed by further overlapping a strip-shaped fabric from the upper end to the lower end. The width dimension of the fabric further overlapped on the side edge portions 12*a* and 13*a* is gradually increased downward.

The upper supporting bodies 20 are provided on the left and right sides and are formed as strip-shaped bodies. The upper supporting body 20 extends upward while the end portion thereof being connected with the upper end 10*a* of the cup body 10 and supports the upper end 10*a* of the cup body 10 so as to pull up the upper end 10*a* from above. In addition, when worn on a human body, the upper supporting body 20 turns backward while curving at a corresponding position of the shoulder of the human body, and the other end extends to a corresponding position of the back part of the human body. Thus, the upper supporting body 20 is allowed to be hung around the shoulder of the human body.

Here, the upper supporting body 20 includes a first upper supporting body 21 and a second upper supporting body 22 on the left and right sides. The first upper supporting body 21 extends upward in a strip shape from the upper end of one edge portion 12*a* which is located at the position relatively far away from the intermediate portion 40' between the left and right cup bodies 10 in the left and right side edge portions 12*a*,13*a* of the first region 11. The second upper supporting body 22 extends upward in a strip shape from the upper end of the other edge portion 13*a* which is located at the position relatively close to the intermediate portion 40' between the left and right cup bodies 10 in the left and right side edge portions 12*a*, 13*a* of the first region 11.

The first upper supporting body 21 is continuously and integrally formed with the further overlapped fabric of one edge portion 12*a* of the first region 11 of the cup body 10, and the second upper supporting body 22 is continuously integrally formed with the further overlapped fabric of the other edge portion 13*a* of the first region 11 of the cup body 10.

That is, the width dimensions of the first upper supporting body 21 and the second upper supporting body 22 are increased gradually downward, the fabric is continuously and integrally formed, and be set larger.

The first upper supporting body 21 and the second upper supporting body 22 configured in this way are connected at the upper end and the connected shape is formed in an inverted V shape, more specifically, is formed by connecting at the upper end while gradually decreasing the interval in an inverted V shape upward. When the first upper supporting body 21 and the second upper supporting body 22 are worn on a human body, the position of the upper end of the inverted V shape is positioned at a corresponding position of the front part of the human body where is above the breast of the human body. The upper supporting bodies 20 further include third upper supporting bodies 23 on the left and right sides.

That is, the third upper supporting body 23 extends upward from the upper end of the inverted V shape formed by the first upper supporting body 21 and the second upper supporting body 22, turns backward while curving at a corresponding position of the shoulder of the human body and extends to a corresponding position of the back part of the human body. Thereby, the third upper supporting body 23 can be hung around the shoulder of the human body.

On the side of the upper supporting body 20, more specifically, the side of the corresponding position of the rear portion of the third upper supporting body 23, an adjuster 24 is provided. By adjusting the position of this adjuster 24 up and down, the length of the upper supporting body 20 can be adjusted. The adjuster 24 can be formed using a material other than metal, for example plastic, preferably natural plastic.

The lower supporting bodies 30 are provided on the left and right sides and are formed as strip-shaped bodies. The lower supporting body 30 is connected with the lower end of the cup body 10 at the upper end and extends in the left-right direction to the intermediate portion between the left and right cup bodies 10 while rising obliquely upward at a predetermined angle in a curved shape. The lower supporting body 30 supports the lower end of the cup body 10.

The lower supporting bodies 30 are formed to further extend backward from the lower end of the cup bodies 10 to the corresponding position of the back part of the human body so as to wind in the left-right direction along the human body, and at the corresponding position of the back part of the human body, left and right end portions 30*a*, 30*b* are formed to be separated from each other. The separated end portions 30*a*, 30*b* of the lower supporting bodies 30 and the other end side of the upper supporting bodies 30 are connected. The lower supporting body 30 is formed so as to increase the width dimension gradually toward the corresponding position of the back part from the corresponding position of the front part of the human body. The increase rate of the width dimension of the lower supporting body 30 is set to be larger at the corresponding position of the side part and the back part of the human body than at the corresponding position of the front part of the human body.

Here, the above-described cup body 10 is formed such that the lower end of the cup body 10 rises obliquely upward in a curved shape at an angle larger than the rising angle of the upper end of the lower supporting body 30 toward the intermediate portion between the left and right cup bodies 10. Then, the lower end of the cup body 10 and the upper end of the lower supporting body 10 are connected from the lower end 10*b* of the end portion on a side of the cup body 10 to the lower end 10*c* of the central portion of the cup body 10, and are separated from each other while gradually increasing the interval toward the intermediate portion 40' between the left and right cups 10 from the lower end 10*c* of the central portion. Thus, an opening 31 is formed between the lower end of the cup body 10 and the lower supporting body 30 from the lower end of central portion of the cup body 10 to the intermediate portion 40'. This opening 31 is set to have a substantially triangular shape.

It should be noted that the upper end of the lower supporting body 30 are connected with the side end 12*a'* of one edge portion 12*a* of the first region 11 of the cup body 10 formed continuously and integrally with the first upper supporting body 21. On the other hand, the side end 13*a'* of the other edge portion 13*a* of the first region 11 of the cup body 10 formed continuously and integrally with the second upper supporting body 22 is located at the upper end of the opening 31 and separated from the upper end of the lower supporting body 30 via the opening 31.

The connecting body 40 is provided at the intermediate portion 40' between the left and right cup bodies 10, and is provided at the intermediate portion 40" between the left and right lower supporting bodies 30. That is, the connecting body 40 has a function of connecting the left and right cup bodies 10 as well as the left and right lower supporting bodies 30 at the intermediate portions 40', 40" and has a function of maintaining the balance between the left and right sides of the brassiere 1. As is apparent from the drawing, the above-mentioned opening 31 is formed in a substantially triangular shape surrounded by the side end of the cup body 10, the upper end of the lower supporting body 30 and the connecting body 40.

The fastening body 50 is provided on the left and right sides and is formed as a strip-shaped body. The fastening body 50 has a function of fastening the lower supporting bodies 30 to the human body.

The fastening body 50 extends forward from each of the separated left and right end portions 30*a*, 30*b* of the lower supporting bodies 30 in the left-right direction, more specifically, extend to the oblique downside of the left-right direction so as to cross between the separated end portions 30*a*, 30*b* and wind along the human body, and when the brassiere is worn on the human body, the length is set to be the length from the back part of the human body to the front part of the human body. That is, it is possible for the end portions 50*a*, 50*b* of the fastening body 50 to reach the corresponding position of the front part of the human body, and to be connected at the corresponding position of the front part of the human body so as to form a knot 50' such as a ball knot, a butterfly knot, or the like. An inserting portion 50" is provided at the side end on the front portion side of the lower supporting body 30.

More specifically, a first annular body 32 is provided at one end portion 30*a* of the separated left and right of end portions 30*a*, 30*b* of the lower supporting bodies 30, and a second annular body 34 is provided at the other end portion 30*b*.

Further, the first annular body 32 and the second annular body 34 are respectively provided at at least two places of the upper position and the lower position. The fastening body 50 is fixed to the intermediate portion of one strip-shaped body through either one of the first annular body 32 at the upper position and the second annular body 34 at the upper position.

Then, with respect to the fastening body 50, in a further fixed state, one end portion 50*a* is inserted through any other one of the first annular body 32 at the upper position and the second annular body 34 at the upper position and the direction is reversed, and one end portion 50*a* is further inserted through any one of the first annular body 32 at the lower position and the second annular body 34 at the lower position and the direction is reversed, so that the fastening body 50 extends in the left-right direction, more specifically, extends to the obliquely lower side of the left-right direction so as to reach the corresponding position of the front part of the human body.

Further, with respect to the fastening body 50, in a further fixed state, the other end portion 50*b* is inserted through any other one of the first annular body 32 at the lower position and the second annular body 34 at the lower position and the direction is reversed, so that the fastening body 50 extends in the left-right direction, more specifically, extends to the obliquely lower side of the left-right direction so as to reach the corresponding position of the front part of the human body. It should be noted that, the first annular body 32 and the second annular body 34 are formed by using a material other than metal, for example plastic, more preferably natural plastic.

As describe above, in the present embodiment, in the cup body 10, the side end rises obliquely upward in a curved shape at an angle larger the rising angle of the lower supporting body 30 toward the intermediate portion between the left and right cup bodies 10, and the side end of the cup body 10 and the upper end of the lower supporting body 30 are separated from each other while gradually widening the interval toward the intermediate portion between the left and right cup bodies 10. As a result, it is possible to maintain the shape of the breast of the human body by the cup body 10 and the lower supporting body 30, and to keep the movement of the breast and reduce the fastening and wearing stress by separating the side end of the cup body 10 from the lower supporting body 30 while widening the interval gradually toward the intermediate portions 40', 40".

In addition, the cup body 10 is divided into three regions in the left-right direction and includes a first region 11 corresponding to the center position of the breast of the human body; and a second region 12 and a third region 13 located on both sides of the first region 11. The side edge portions 12*a*, 13*a* of both side ends of the first region 11 are further overlapped with strip-shaped fabric 12*b*, 13*b* from the upper end to the side end. The upper supporting body 20 includes a first upper supporting body 21 and a second upper supporting body 22 on the left and right sides. The first upper supporting body 21 extends upward from the upper end of one edge portion 12*a* of the first region 11 in a strip shape, and the second upper supporting body 22 extends upward from the upper end of the other edge portion 13*a* of the first region 11 in a strip shape. Therefore, it is possible to keep the central portion of the breast of the human body between the first upper supporting body 21 and the second upper supporting body 22 to maintain a good shape.

Further, the first upper supporting body 21 is continuously integrated with the further overlapped fabric of one edge portion 12*a* of the first region 11 of the cup body 10, and the second upper supporting body 22 is continuously integrated with the further overlapped fabric of the other edge portion 13*a* of the first region 11 of the cup body 10. Therefore, it is possible to further keep the central portion of the breast of the human body between the first upper supporting body 21 and the second upper supporting body 22 to maintain the good shape.

Furthermore, the side end 12*a*' of one edge portion 12*a* of the first region 11 of the cup body 10 continuously integrated with the first upper supporting body 21 is connected with the upper end of the lower supporting body 30, and the side end 13*a*" of the other edge portion 13*a* of the first region 11 of the cup body 10 continuously integrated with the second upper supporting body 22 is located at the upper end of the opening 31. The side end 13*a*" is separated from the upper end of the lower supporting body 30 via the opening 31. Therefore, it is possible to further maintain the shape of the breast of the human body by the first upper supporting body 21, the second upper supporting body 22, the cup body 10, and the lower supporting body 30, and it is also possible to keep the free movement of the breast by separating the side end 13*a*" of the other edge portion 13*a* of the first region 11 from the upper end of the lower supporting body 30.

Furthermore, a left and right strip-shaped fastening body 50 for fastening the lower supporting bodies 30 to the human body is included. The lower supporting body 30 further extends from the side end of the cup body 10 to the corresponding position of the back part of the human body, and at the corresponding position of the back part of the human body, the left and right end portions 30*a*, 30*b* are separated from each other. The fastening body 50 extends in the left-right direction from each of the separated left and right end portions 30*a*, 30*b* of the lower supporting body 30 so as to cross between the separated end portions 30*a*, 30*b*, and the end portions 50*a*, 50*b* of the fastening bodies 50 reach the corresponding position of the front part of the human body. Therefore, when the fastening body 50 is pulled in the left-right direction, more specifically, to the obliquely lower side, the left and right lower supporting bodies 30 are also pulled and the interval between the separated end portions 30*a*, 30*b* becomes narrow, so that the lower supporting body 30 can be fastened to the human body. In addition, by pulling the fastening body 50 to the obliquely lower side in the left-right direction, the upper supporting body 20 connected with the lower supporting body 30 is also pulled downward, whereby the whole brassiere 1 can be fastened to the human body. Further, the end portions 50*a*, 50*b* of the fastening body 50 can be tied at the front part of the human body so as to form a knot 50', the fastening work can be easily performed, and the adjustment of the fastening force can be easily performed.

Further, since the brassiere 1 is formed using Oshima pongee, the brassiere can be flexible, have good touch feeling to the skin and be light, and the stress of the user caused by wearing the brassiere can be remarkably relieved. Oshima pongee is excellent in breathability and antibacterial properties and is also suitable for using in underwear.

That is, Oshima pongee is one of the world's three great fabrics, and is a silk fabric, more specifically, a pongee fabric of Amami Oshima Island in Kagoshima Prefecture. Oshima pongee is a woven fabric which is mordanted mainly by the mudding technique, yarn-dyed, and manually woven with a shimebata machine. It is known that when such Oshima pongee is used and washed repeatedly, the more it is worn the better flexibility and touch feeling it will have. It is suitable as a material for underwear such as a brassiere, which has a large effect of releasing the stress at the time of wearing.

Of course, the present invention is not limited to the above-described embodiment, and various modifications can be made within the scope of the invention described in the claims That is, for example, in the above-described embodiment, the upper supporting body 20, the lower supporting body 30, and the fastening body 50 are formed as a strip-shaped body, but a desired effect can be also obtained with a string-shaped body. However, it is more preferable to form the upper supporting body 20, the lower supporting body 30, and the fastening body 50 as strip-shaped body than a string-shaped body.

In addition, in the above-described embodiments, the upper supporting body 20 has the first upper supporting body 21 to the third upper supporting body 23. But, like the brassiere 100 shown in FIG. 3 and FIG. 4, a desired effect can also be obtained even by a configuration where the upper supporting body is used as only one upper supporting body 120 for pulling up and supporting the cup body 110. However, it is more preferable for the upper supporting body to have the first upper supporting body 21 to the third upper supporting body 23 as in the above-described embodiment, rather than as one upper supporting body.

Figure 3:
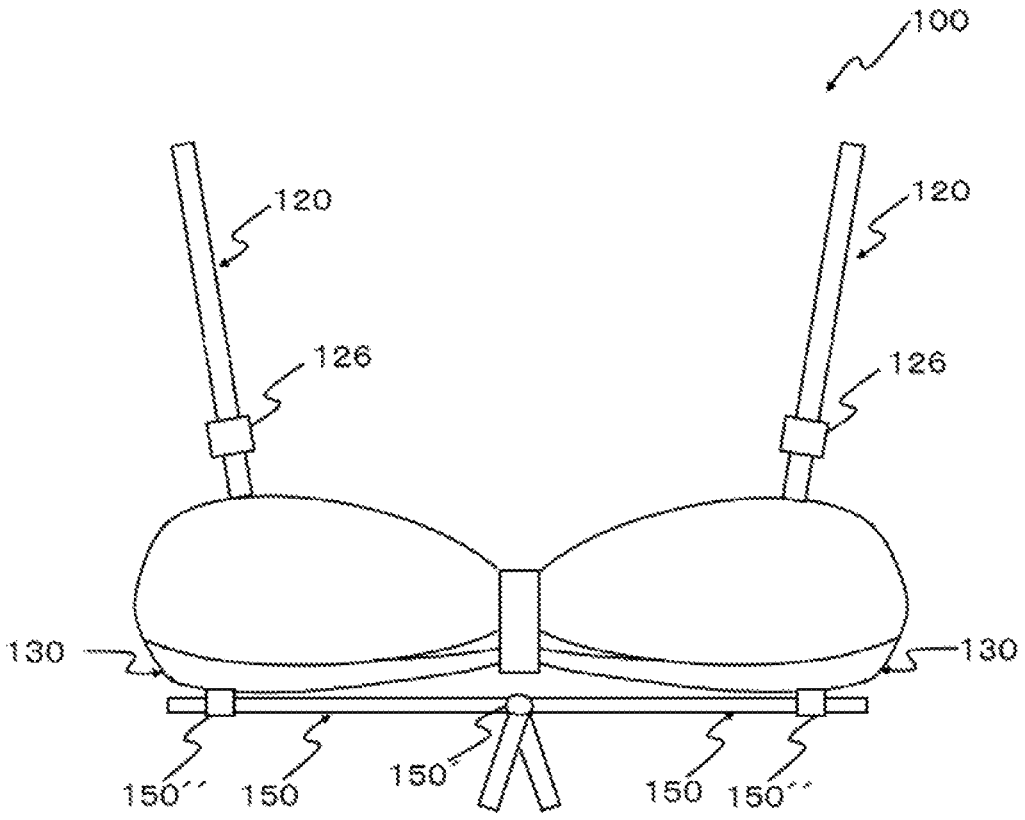
FIG. 3 is a front view showing an overall configuration of a brassiere according to a modified embodiment of the present invention.

The brassiere 100 has been worn on the breasts of the human body although the drawing of the human body is omitted, and is a rear view showing only the rear portion side of the brassiere 100 (a rear view in which the front portion side of the brassiere 100 is omitted)), the left and right upper supporting bodies 120 cross at a corresponding position of the back part of the human body above the lower supporting body 130, and may have an adjuster 125 for adjusting the crossing position of the upper supporting bodies 120 in the up-down direction. This adjuster 125 is an annular body movable in the up-down direction, and the crossing portion of left and right upper supporting bodies 120 are inserted through the annular body. The adjuster can be formed by using a material other than metal, for example plastic, more preferably natural plastic. As shown in FIG. 3, adjusters 126 may be provided on the left and right upper supporting bodies 130 on the front portion side of the human body.

Figure 4:
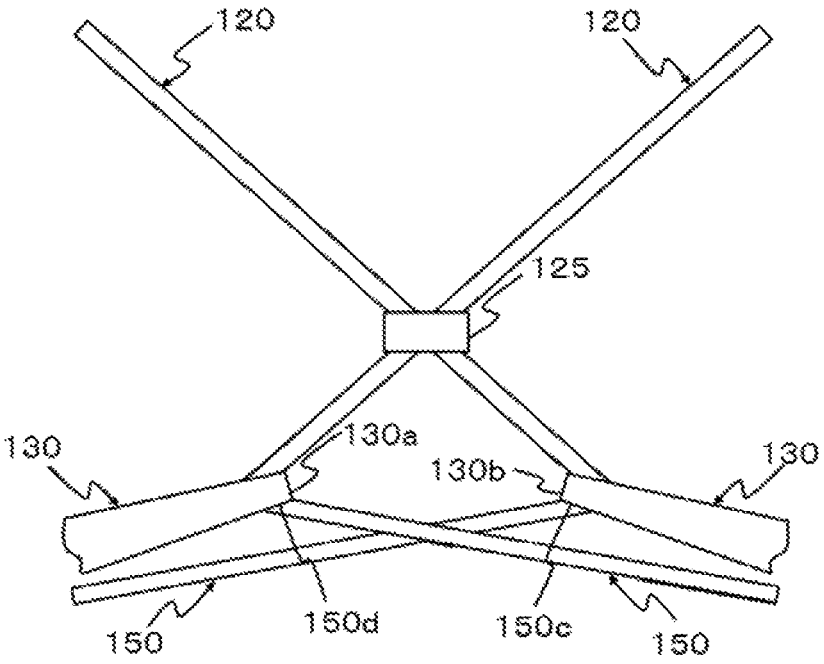
FIG. 4 is a rear view showing the overall configuration of the same brassiere.

Furthermore, as shown in FIG. 3 and FIG. 4, the other end portions 150*c*, 150*d* of the fastening bodies 150 are fixed to the separated left and right end portions 130*a*,130*b* of the lower supporting bodies 130, and extend in the left-right direction, more specifically, to the obliquely lower side of the left-right direction from the separated left and right end portions 130*a*,130*b* of the lower supporting bodies 130 separately so as to cross each other below and between the end portions 130*a*, 130*b*, and the length is set to be a length from the back part of the human body to the front part of the human body, so that the desired effect can be obtained even the knot 150' is formed at a corresponding position in the front part of the human body. An inserting portion 150" is provided at the side end on the front portion side of the lower supporting body 130.

In addition, in the above embodiment, the brassiere 1 is formed using Oshima pongee, but it is also possible to obtain the desired effect even it is formed using other natural materials such as cotton, linen and the like. However, it is more preferable to form the brassiere 1 using Oshima pongee, rather than forming the brassiere 1 by using cotton, linen or the like.

As described above, the brassieres 1, 100 of the present invention are formed by using a natural material as apparent from the above, and are formed without using metal such as a wire, rubber or the like.

Other Inventions

Figure 5:
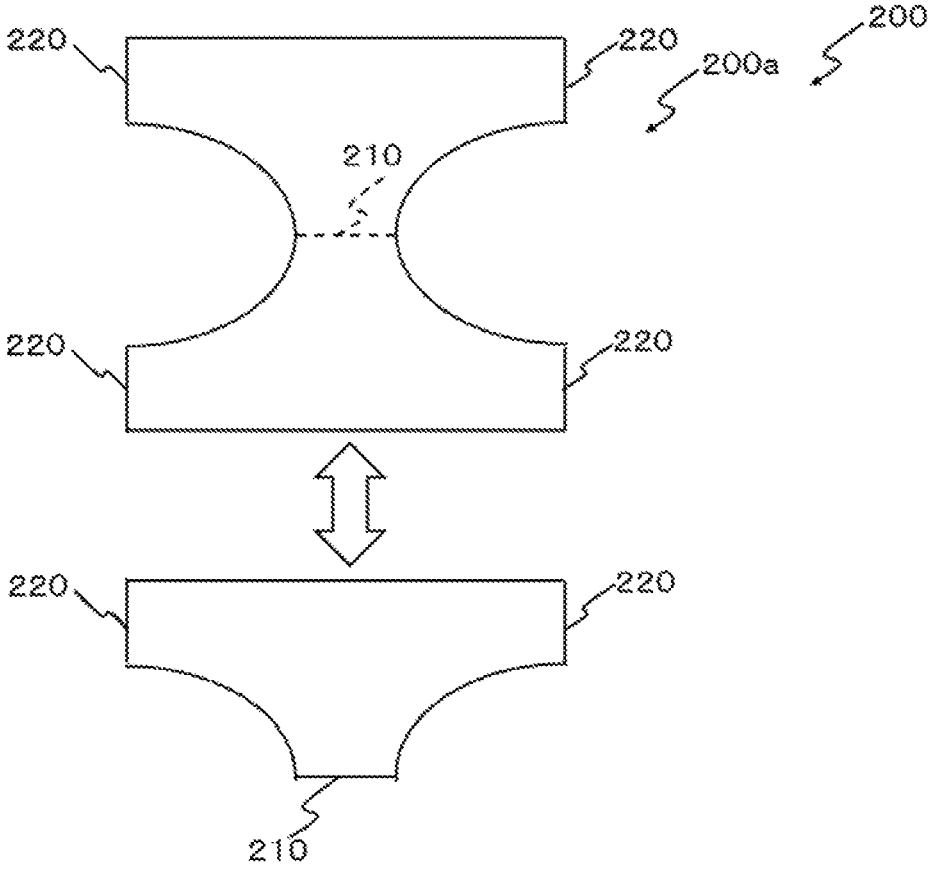
FIG. 5 is a view showing a configuration of a panty according to another invention.

As shown in FIG. 5, when forming a panty 200, a piece of cloth is formed into an expanded shape 200*a* of a panty which is continuous at a corresponding position of the crotch 210 and sewn only at the side end portions 220. Thus, it is possible to omit sewing at the corresponding position of the crotch 210 and to eliminate the seam at the corresponding position of the crotch 210. By eliminating the seam at the corresponding position of the crotch 210 in this way, it is possible to reliably prevent the seam of the panty from floating on clothes when wearing clothes.

Figure 6:
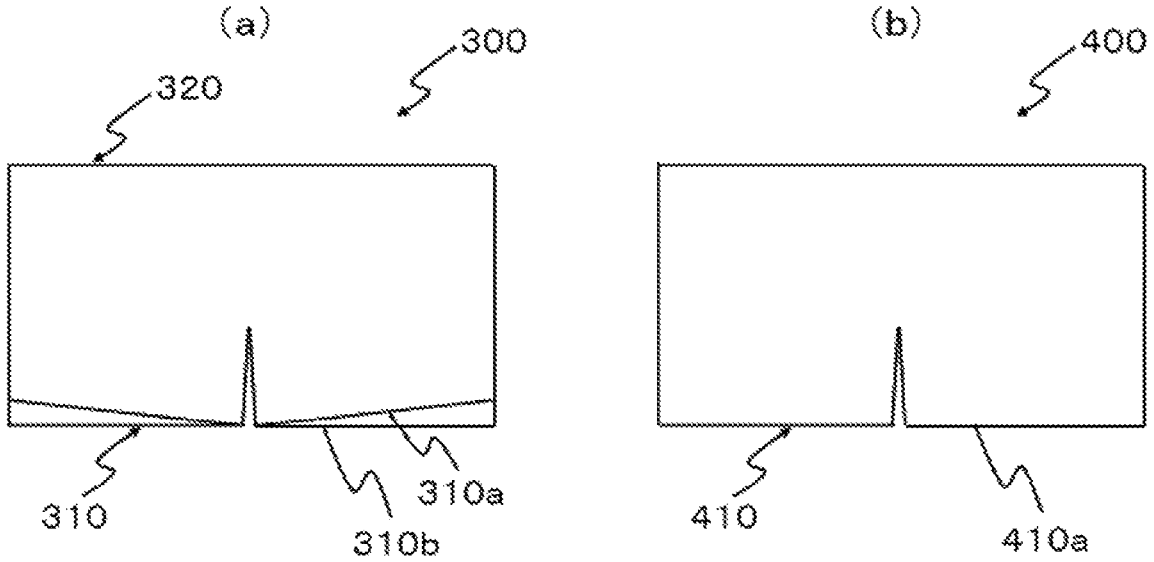
FIG. 6 is a view showing a configuration of a trunk according to another invention, wherein (a) is a front view showing a configuration of the truck of the present invention, and (b) is a front view showing a configuration of a conventional trunk.

In addition, as shown in FIG. 6(*a*), trunks 300 have a pair of leg inserting portions 310 in the lower portion for inserting the legs of the human body and a torso inserting portion 320 in the upper portion for inserting and holding the torso of the human body. By forming the lower end 310*a* in the front portion of the leg inserting portion 310 to gradually rise obliquely upward from the inside toward the outside, the trunks 300 are pulled by the buttocks of the human body, for example, when sitting or the like, and it is possible to set the position of the lower end 310*a* in the front portion of the leg inserting portion 310 at a corresponding position of the thigh root of the human body (as is apparent from the drawing, the lower end 310*b* in the back portion of the leg inserting portion 310 extends in the left-right direction).

That is, as shown in FIG. 6(*b*), in the conventional trunks 400, the lower end 410*a* in the front portion of the leg inserting portion 410 extends substantially horizontally from the inside toward the outside, and the position of the lower end 410*a* in the front portion of the leg inserting portion 410 is set to be at a position in front of the thigh root of the human body (upper portion of the leg) when siting or the like, and it was pointed out that there are tense feeling and strange feeling when siting or the like.

By forming the trunks 300 as shown in FIG. 6(*a*), it is possible to reduce the strange feeling caused by the tense feeling and to improve the comfortableness

Possibility of Application for Industry

The present invention can provide a brassiere capable of keeping the movement of the breasts and reducing the fastening while maintaining the shape of the breasts, and greatly contribute to the development of the underwear industry.

EXPLANATION OF REFERENCE SYMBOLS

1: brassiere
10: cup body
11: first region
12: second region
13: third region
20: upper supporting body
21: first upper supporting body
22: second upper supporting body
23: third upper supporting body
24: adjuster
30: lower supporting body
31: opening
32: first annular body
34: second annular body
40: connecting body
50: fastening body
100: brassiere
120: upper supporting body
125, 126: adjuster
130: lower supporting body
150: fastening body
200: panty
210: corresponding position of crotch
220: side end portion
300: trunks
310: leg inserting portion
320: torso inserting portion
400: conventional trunks
410: leg inserting portion

We claim:

1. A brassiere, comprising: left and right cup bodies for holding breasts of a human body; left and right upper supporting bodies for supporting the cup bodies from above; and left and right lower supporting bodies for supporting lower ends of the cup bodies, the left and right lower supporting bodies being connected with the lower ends of the cup bodies and extending in left-right direction, the lower end of the cup body and the lower supporting body are separated from each other while widening an interval gradually toward an intermediate portion between the left and right cup bodies so as to have an opening between the lower end of the cup body and the lower supporting body.

2. The brassiere according to claim 1, wherein the cup body is composed of a first region corresponding to a center position of a breast of the human body, and a second region and a third region located on both sides of the first region, left and right side edge portions of the first region are further overlapped by a fabric from an upper end to a lower end, and the upper supporting body comprises a first upper supporting body and a second upper supporting body on left and right sides, wherein the first upper supporting body extends upward from an upper end of one edge portion of the left and right side edge portions of the first region, and the second upper supporting body extends upward from an upper end of the other edge portion of the left and right side edge portions of the first region.

3. The brassiere according to claim 1, wherein the first upper supporting body is continuously integrated with a further overlapped fabric of one edge portion of the first region of the cup body, and the second upper supporting body is continuously integrated with a further overlapped fabric of the other edge portion of the first region of the cup body.

4. The brassiere according to claim 3, wherein the lower end of one edge portion of the first region of the cup body continuously integrated with the first upper supporting body is connected with an upper end of the lower supporting body, and the lower end of the other edge portion of the first region of the cup body continuously integrated with the second upper supporting body is located at an upper end of the opening, and separated from the lower supporting body via the opening.

5. The brassiere according to claim 1, comprising a left and right fastening body for fastening the lower supporting bodies to the human body, wherein the lower supporting body further extends in the left-right direction from the lower end of the cup body to a corresponding position of a back part of the human body, and left and right end portions thereof are separated from each other at the corresponding position of the back part of the human body, the fastening body extends in the left-right direction from each of the separated left and right end portions of the lower supporting bodies, and end portions of the fastening body reach a corresponding position of a front part of the human body.

6. The brassiere according to claim 1, wherein the brassiere is formed by using a natural material.

7. The brassiere according to claim 1, wherein the natural material is Oshima pongee, cotton, or linen.

* * * * *